US005883601A

United States Patent [19]

Tanaka et al.

[11] Patent Number: 5,883,601

[45] Date of Patent: Mar. 16, 1999

[54] PLURAL SLOT ANTENNA FED WITH DIELECTRIC STRIP AND DIELECTRIC RESONATORS

[75] Inventors: Nobuaki Tanaka, Nagaokakyo; Kazunari Kawahata, Kyoto; Seiichi Arai, Takatsuki, all of Japan

[73] Assignee: Murata Manufacturing Co. Ltd., Kyoto, Japan

[21] Appl. No.: 934,120

[22] Filed: Sep. 19, 1997

Related U.S. Application Data

[63] Continuation of Ser. No. 649,774, May 14, 1996, abandoned.

[30] Foreign Application Priority Data

May 19, 1995 [JP] Japan ..... 7-121745

[51] Int. Cl.[6] ..... H01Q 13/100

[52] U.S. Cl. ..... 343/753; 343/770

[58] Field of Search ..... 343/753, 770, 343/771, 785, 700 MS File; H01Q 13/020, 13/100

[56] References Cited

U.S. PATENT DOCUMENTS

| | | | |
|---|---|---|---|
| 4,958,165 | 9/1990 | Axford et al. | 343/771 |
| 4,975,711 | 12/1990 | Lee | 343/702 |
| 5,489,913 | 2/1996 | Raguenet et al. | 343/770 |

FOREIGN PATENT DOCUMENTS

| | | |
|---|---|---|
| 2705167 | 11/1994 | France . |
| 1605231 | 5/1985 | United Kingdom . |

OTHER PUBLICATIONS

Patent Abstracts of Japan, vol. 95, No. 8, 29 Sep. 1995 & JP–A–07 131235 (Metsui Eng & Shipbuild), 19 May 1995, abstract.

Patent Abstracts of Japan, vol. 17, No. 57 (E–1315), 4 Feb. 1993 & JP–A–04 266204 (Fujitsu), 22 Sep. 1992, abstract.

Patents Abstracts of Japan, vol. 9, No. 266 (E–352) [1989], 23 Oct. 1985 & JP–A–60 113502 (Nihon Musen), 20 Jun. 1985, abstract.

*Primary Examiner*—Michael C. Wimer

*Attorney, Agent, or Firm*—Ostrolenk, Faber, Gerb, & Soffen, LLP

[57] ABSTRACT

A dielectric antenna is provided which is capable of setting the radiation of electromagnetic waves at a desired angle. The dielectric antenna has a nonradiative dielectric guide (an NRD guide) of a construction in which a dielectric strip is sandwiched between a first planar conductor and a second planar conductor. A dielectric resonator is disposed between the first planar conductor and the second planar conductor along the extension line of the dielectric strip, and a plurality of slots are disposed in the second planar conductor above the dielectric resonator and symmetrically with respect to the dielectric resonator.

10 Claims, 5 Drawing Sheets

FIG. 7 *PRIOR ART*
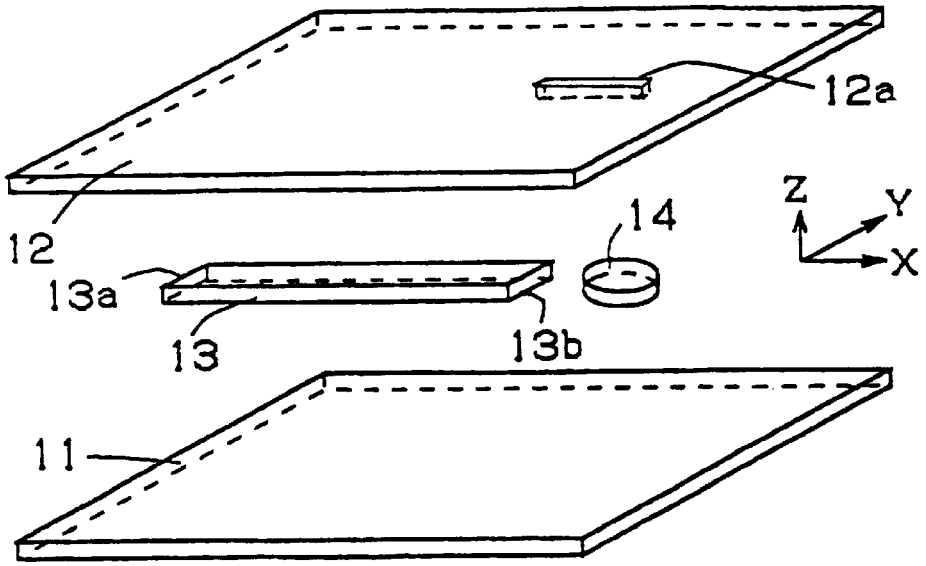
FIG. 8 *PRIOR ART*
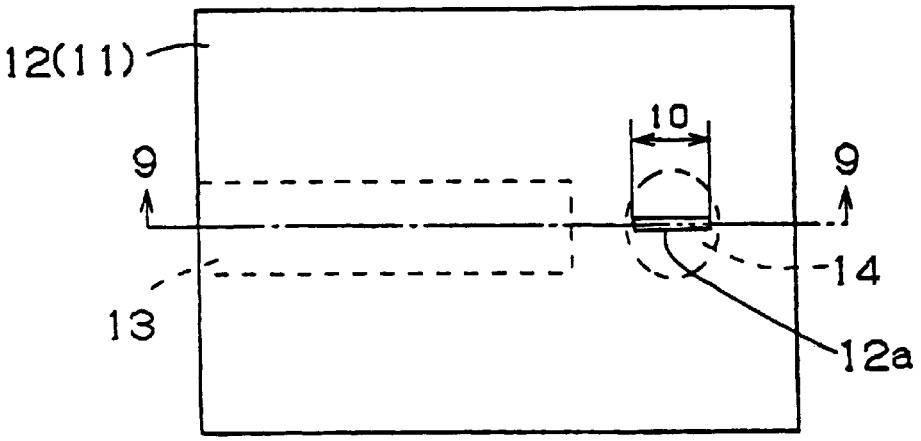
FIG. 9 *PRIOR ART*
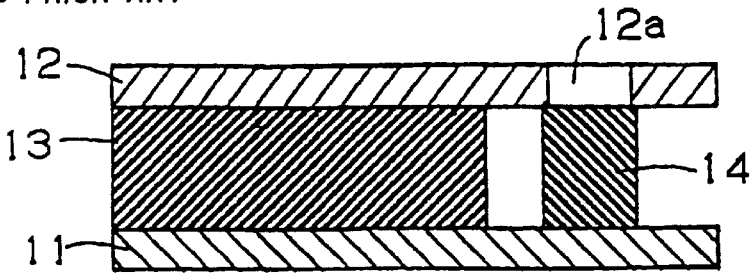

FIG. 10 *PRIOR ART*
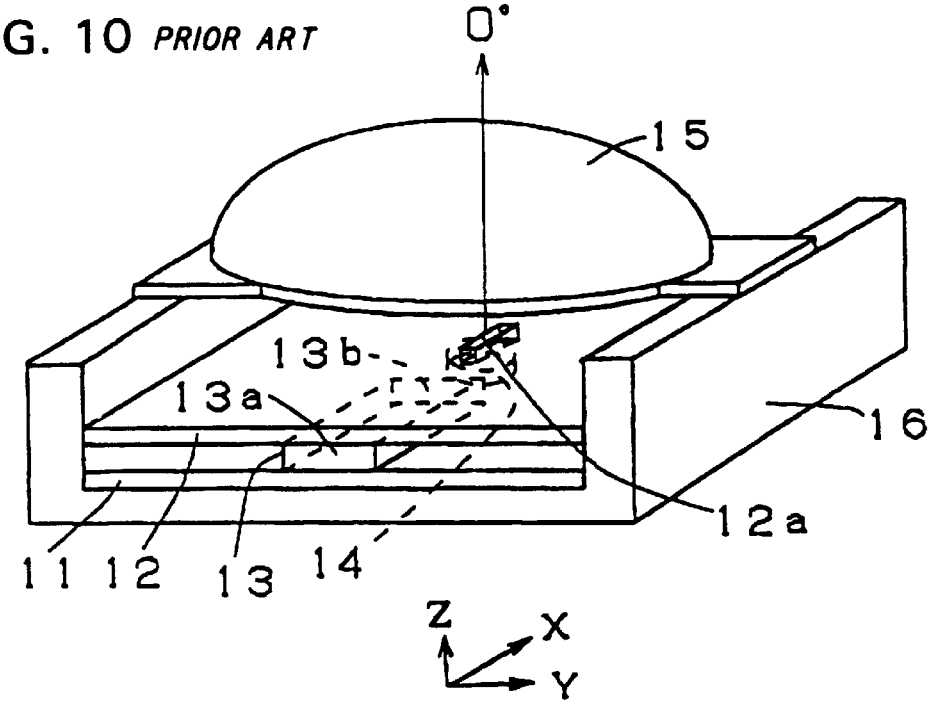
FIG. 11
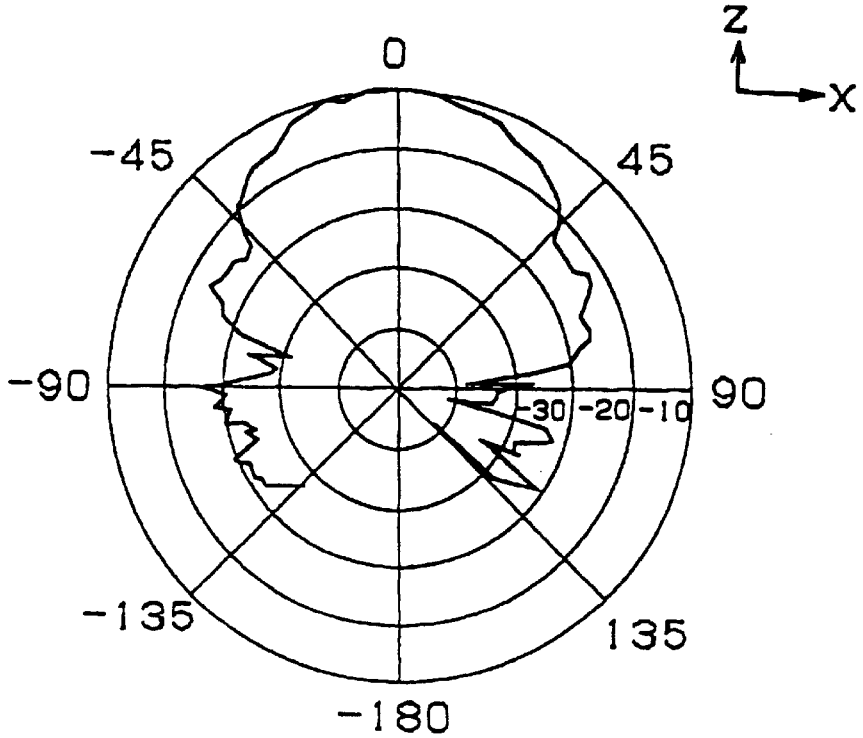

FIG. 12 *PRIOR ART*
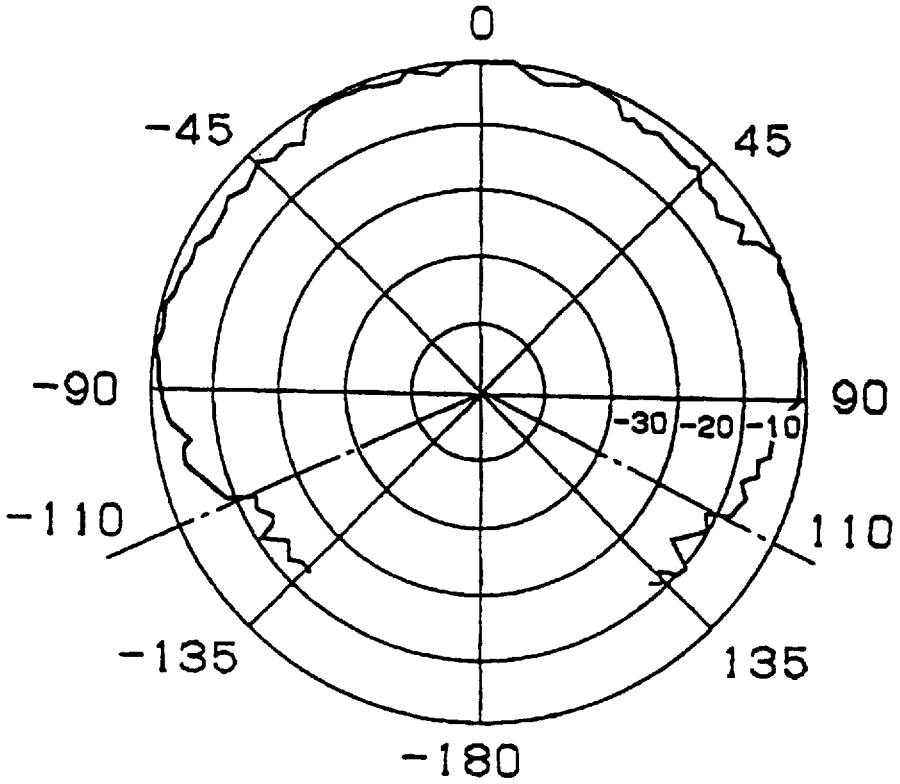

PLURAL SLOT ANTENNA FED WITH DIELECTRIC STRIP AND DIELECTRIC RESONATORS

This is a continuation of application Ser. No. 08/649,774 filed on May 14, 1996, now abandoned.

BACKGROUND OF THE INVENTION

1. Field of the Invention

The present invention relates to a dielectric antenna using a nonradiative dielectric wave guide (an NRD guide) for use for example in an obstruction detector for preventing car accidents, in a radio transmitter, or in another transmitting or receiving device.

2. Description of the Related Art

The inventors of the present invention have filed Japanese Patent Application No. 7-1506 concerning this type of dielectric antenna. In the following description, an XYZ coordinate system is used in which the center of gravity of a dielectric resonator 14 is the point of origin, the extension direction of a dielectric strip 13 is the X direction, and the direction vertical to the principal plane of a conductor 12 is the Z direction.

A conventional dielectric antenna shown in FIGS. 7–9 comprises a first planar conductor 11, and a second planar conductor 12. Disposed between the first planar conductor 11 and the second planar conductor 12 are a dielectric strip 13 and a dielectric resonator 14 spaced from each other along the X axis. One end 13*a* of the dielectric strip 13 is connected to a waveguide and a transmission circuit (not shown), and the other end 13*b* is an open end. Provided in the second planar conductor 12 above the dielectric resonator 14 is a single slot 12*a* substantially parallel to the X axis. In this way, the dielectric strip 13 is placed between the first planar conductor 11 and the second planar conductor 12, thus forming an NRD guide.

As shown in FIG. 10, a dielectric lens 15 is disposed above the slot 12*a*, and thus a dielectric lens antenna is formed. The electromagnetic waves transmitted from the waveguide and the transmission circuit to the dielectric strip 13 are propagated within the dielectric strip 13 in an LSM (Longitudinal Section Magnetic) mode with their electric field having components within the YZ plane and their magnetic field having components within the XZ plane. The dielectric strip 13 and the dielectric resonator 14 are electromagnetically coupled, so that an electromagnetic wave of an HE111 mode having electric-field components in the X direction occurs within the dielectric resonator 14. The electromagnetic wave generated in the dielectric resonator 14 is radiated through the slot 12*a* and the dielectric lens 15.

However, when the broadside directional axis provided by the slot 12*a* is the Z axis, the radiation within the XZ plane ("H plane") along the length of the slot 12*a* is within a range of approximately ±45° with the Z axis as the center. However, the radiation angle within the YZ plane ("E plane") becomes ±90° or more, including electromagnetic field components which are not radiated to the dielectric lens 15 ("spill-over loss").

SUMMARY OF THE INVENTION

It is an object of the present invention to provide a dielectric antenna which is capable of setting the radiation of the electromagnetic wave radiated outside the dielectric antenna at a desired angle and which is capable of reducing the spill-over loss.

To achieve the above-described object, according to one aspect of the present invention, there is provided a dielectric antenna including a nonradiative dielectric guide having a dielectric strip located between a first planar conductor and a second planar conductor, wherein at least one dielectric resonator is disposed along an extension line of the dielectric strip, and a plurality of substantially parallel slots are disposed within the second planar conductor in point symmetry with respect to the dielectric resonator and substantially above the dielectric resonator.

According to another aspect of the present invention, there is provided a dielectric antenna including a nonradiative dielectric guide having a dielectric strip sandwiched between a first planar conductor and a second planar conductor, wherein at least one dielectric resonator is disposed along the extension line of the dielectric strip, and a plurality of substantially parallel slots are disposed in the second planar conductor in line symmetry with respect to the dielectric strip, above and in the vicinity of the dielectric resonator.

According to a further aspect of the present invention, a dielectric lens is disposed above a slot provided within the second planar conductor.

Generally in a linear array antenna, the radiation direction pattern of the antenna, along the plane in which plural slots are aligned, is expressed by the following equations:

$$E(\omega)=\sin(Nu/2)/\sin(u/2) \quad (1)$$

$$u=kd(\cos\theta-\cos\theta_0) \quad (2)$$

where k is the phase constant, d is the distance between respective slots, N is the number of slots and $\theta_0$ is the radiating direction of a main beam.

In accordance with the above equation, it can be clearly understood that when N is constant, the radiation angle at which a power of the main beam is attenuated to 1/10 of its maximum power, is inversely proportional to the distance d.

And the opening area S depends on the distance d. The antenna gain G is characterized by the opening area S, the wavelength $\lambda$ and the opening efficiency $\eta$. These parameters satisfy the following equation:

$$G=4\pi S\eta/\lambda \quad (3)$$

If the opening efficiency is kept constant, the larger the opening area S the larger the gain G.

Therefore, in the present invention, since a plurality of slots are provided within the second planar conductor above a dielectric resonator, the effective opening area along the E plane of the slots becomes wider than in the conventional dielectric antenna, and the radiation angle becomes narrower, and thus the antenna gain is improved. Further, since the coupling between the slots and the dielectric resonator is strong (though the theoretical background for this fact is yet to be clarified), the antenna gain is improved.

Further, in another aspect of the present invention, another dielectric resonator having a pass band which is generally narrower than that of the antenna is disposed between the dielectric strip and the dielectric resonator. Thus, the pass band of the antenna becomes narrower, and its spurious rejection ability is improved. On the other hand, near the peak of the pass band, the pass band width becomes wider than that of the original antenna, so its signal passing characteristic in the vicinity of an intended frequency is improved.

In addition, a dielectric antenna having a high gain can be realized by providing a dielectric lens above the slot so as to concentrate the electromagnetic wave near the slot.

The above and further objects, aspects and novel features of the invention will become more apparent from the following detailed description when read in connection with the accompanying drawings.

BRIEF DESCRIPTION OF THE DRAWINGS

FIG. 7 is an exploded view of a conventional dielectric antenna;

FIG. 8 is a plan view of the conventional dielectric antenna;

FIG. 9 is a sectional view of the conventional dielectric antenna taken along the line B—B of FIG. 8;

FIG. 10 is a perspective view of the conventional dielectric antenna having a dielectric lens mounted therein;

FIG. 11 is a radiation directional pattern diagram showing radiation along the E plane from the slots in the dielectric antenna of an example of the present invention; and FIG. 12 is a radiation directional pattern diagram of radiation along the E plane from the slot in the conventional dielectric antenna.

DESCRIPTION OF THE PREFERRED EMBODIMENTS

Preferred embodiments of the present invention will be described below with reference to the accompanying drawings.

Figure 1:
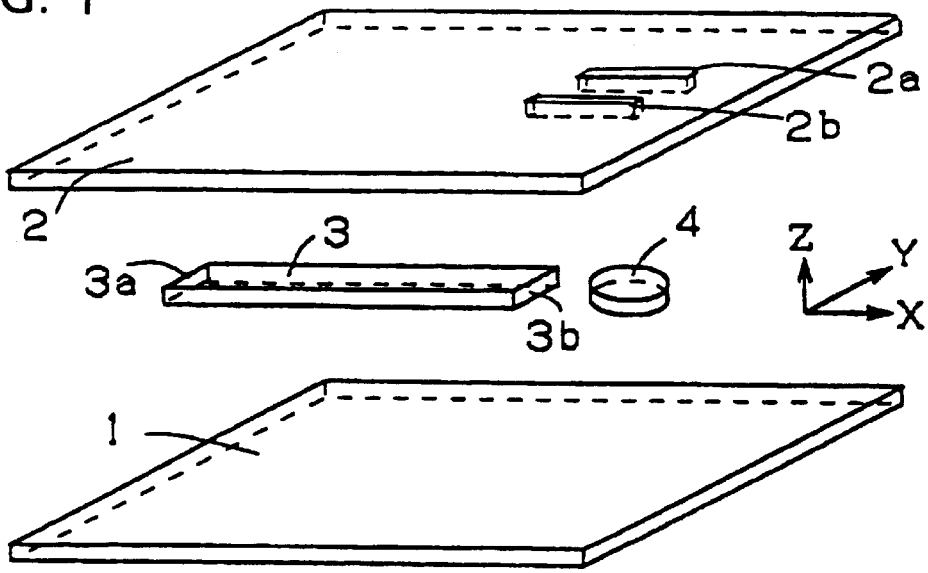
FIG. 1 is an exploded view of a dielectric antenna of an embodiment of the present invention.
Figure 2:
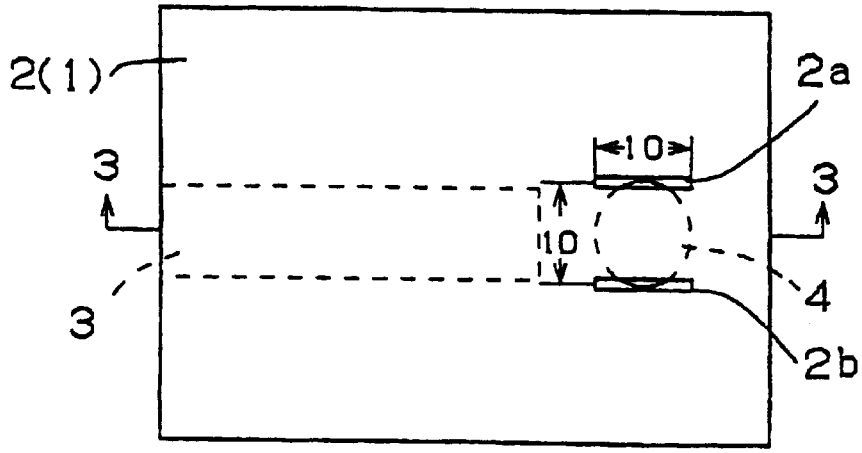
FIG. 2 is a plan view of the dielectric antenna of the embodiment of the present invention.
Figure 3:
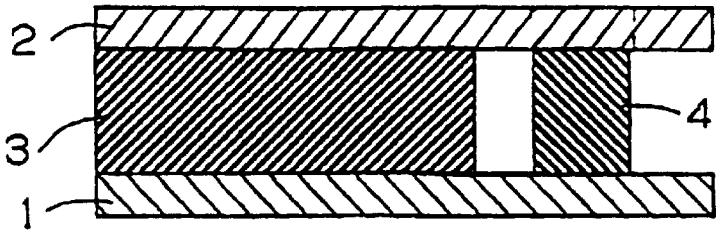
FIG. 3 is a sectional view of the dielectric antenna of the embodiment of the present invention taken along the line A—A of FIG. 2.

A dielectric antenna shown in FIGS. 1–3 includes a first planar conductor (a reverse conductor plate) 1 and a second planar conductor (an obverse conductor plate) 2. Disposed between the first planar conductor 1 and the second planar conductor 2 are a dielectric strip 3 and a dielectric resonator 4 spaced from each other along the X axis. Two rectangular slots 2*a* and 2*b* are provided in parallel and at equal distances from the center line of the dielectric strip 3 within the second planar conductor 2 and above the dielectric resonator 4. The center lines along the length of the slots 2*a* and 2*b* are tangent to the outer periphery of the dielectric resonator 4.

An end portion 3*a* of the dielectric strip 3 is connected to a waveguide and a transmission circuit (not shown), and the other end portion 3*b* is an open end. The construction in which the dielectric strip 3 is sandwiched between the first planar conductor 1 and the second planar conductor 2 constitutes an NRD guide.

Next, the operation of this embodiment will be described. The electromagnetic waves transmitted from the waveguide, the transmission circuit and the like to the dielectric strip 3 propagate within the dielectric strip 3 in an LSM (Longitudinal Section Magnetic) mode which causes an electric field having components within the YZ plane and a magnetic field having components within the XZ plane. The dielectric strip 3 and the dielectric resonator 4 are electromagnetically coupled, whereby an electromagnetic wave of an HE111 mode having electric-field components in the same direction as that of the LSM mode of the dielectric strip 3 occurs within the dielectric resonator 4. The electromagnetic wave is radiated by the dielectric resonator 4 via the slots 2*a* and 2*b*.

In this embodiment, since the two slots 2*a* and 2*b* are provided in the second planar conductor 2 in parallel with the center line of the second planar conductor 2 and in line symmetry with respect to the center line of the dielectric strip 3, the effective opening area of the E plane (the YZ plane in FIG. 1) becomes wide, and the radiation angle becomes sharp.

Next, a second embodiment of the present invention will be described with reference to FIG. 4. In this embodiment, in addition to the elements included in the first embodiment, a second dielectric resonator 4*a* is disposed between the dielectric strip 3 and the dielectric resonator 4. Since the other components of this embodiment are the same as those of the first embodiment, the components are given the same reference numerals, and a description thereof is omitted.

In this embodiment, since the second dielectric resonator 4*a* is added, the filtering effect is improved, making it possible to shut out harmonics or to achieve a greater bandwidth in the vicinity of the passband of the filter.

Figure 5:
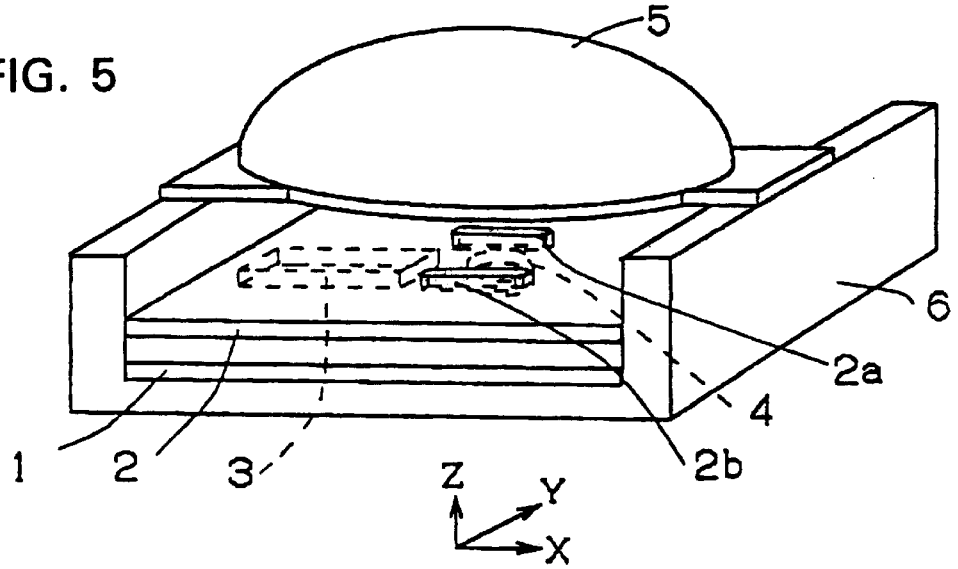
FIG. 5 is a perspective view of a dielectric antenna of a third embodiment of the present invention.

Next, a third embodiment of the present invention will be described with reference to FIG. 5. In this embodiment, the dielectric antenna of the first embodiment is housed in a housing 6, and a dielectric lens 5 is disposed above the slots 2*a* and 2*b*, whereby the directivity and the gain of the radiation electromagnetic wave are improved.

In this embodiment, based on the equations (1) and (2), the spacing between the slots was adjusted in the range of $0.5\lambda$ to $0.45\lambda$, to realize radiation angles of ±45° to ±60°, respectively, whereby most of the electromagnetic waves radiated from the slots 2*a* and 2*b* are applied onto the dielectric lens 5.

Figure 6A:
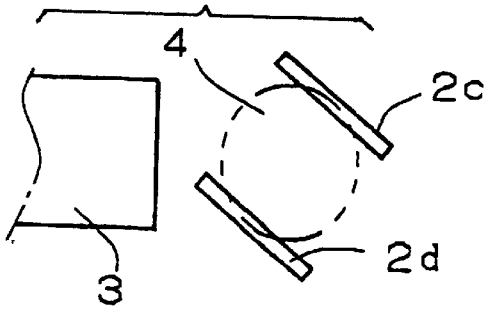
FIGS. 6A and 6B show slots provided in other embodiments of the present invention.

Although the above-described respective embodiments describe a case in which the slots 2*a* and 2*b* are disposed parallel to the center line of the dielectric resonator 4, the slots may not be parallel to the center line of the dielectric strip 3, as illustrated by slots 2*c* and 2*d* in FIG. 6A. This is due to the reason that the coupling of the slots and the HE111 mode are achieved to a certain degree even in such an arrangement. Such an arrangement of slots may be used if desired for convenience in manufacturing the antennas.

Generally speaking, it is permitted for a plurality of substantially parallel slots to be arranged at positions substantially in point symmetry with respect to the dielectric resonator 4.

Figure 6B:
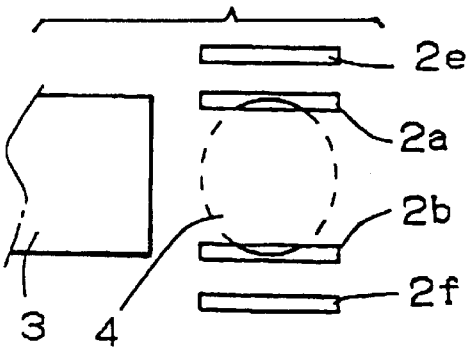

FIG. 6B shows a case in which other slots 2*e* and 2*f* which are substantially parallel to the slots 2*a* and 2*b* are disposed to the outside of the slots 2*a* and 2*b*. When, as described above, the number of slots is four, the effective opening area along the E plane becomes wider, and thus the beam width can be made narrower.

Next, a specific example of the present invention will be described. For the sake of comparison, a prior art case is also shown. The conditions are as shown in the table below.

TABLE 1

Figure 4:
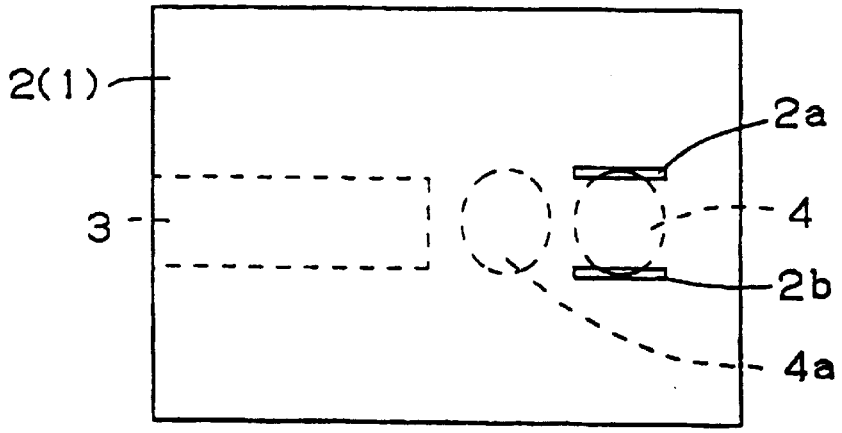
FIG. 4 is a plan view of a dielectric antenna of a second embodiment of the present invention.

| | The present invention | Prior Art |
|---|---|---|
| Reference figure | FIG. 4 | FIG. 7 |
| Number of slots | 2 | 1 |
| Size of slots | Length: 10 mm<br>Width: 0.4 mm | 10 mm<br>0.4 mm |
| Diameter of radiator | 11.9 mm | 11.9 mm |

The radiation directional pattern along the E plane of the primary radiator, measured in the above specific example, is shown in FIG. 11 (the present invention) and FIG. 12 (the prior art). It can be understood from these FIGS. 11 and 12 that the directivity along the E plane of the present invention having two slots is sharper than that of the prior art having one slot. That is, in FIG. 11 of the present invention, the radiation angle of a 10 dB drop of the main beam in the E plane is ±45° from the center of the main beam, while in FIG. 12 of the prior art, the radiation angle is ±110°. Further, while the antenna efficiency of the example of the present invention is 44%, the antenna efficiency of the prior art example is 30%. The antenna efficiency of the present invention is improved by approximately 10% over that of the prior art. The antenna efficiency is expressed by the ratio of the gain obtained experimentally to the directional gain calculated theoretically from the directional pattern.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. A dielectric antenna comprising:

a nonradiative dielectric guide having a dielectric strip sandwiched between a first planar conductor and a second planar conductor;

a dielectric resonator disposed between said first planar conductor and said second planar conductor along an extension line of said dielectric strip;

a plurality of substantially parallel slots disposed symmetrically with respect to said dielectric resonator in the second planar conductor above said dielectric resonator; and further comprising a second dielectric resonator disposed between the first-mentioned dielectric resonator and said dielectric strip along the extension line of the dielectric strip.

2. A dielectric antenna according to claim 1, wherein said plurality of substantially parallel slots are disposed symmetrically with respect to a center line of said dielectric strip.

3. A dielectric antenna according to claim 1, wherein said plurality of substantially parallel slots are disposed symmetrically with respect to a center point of said dielectric resonator.

4. A dielectric antenna according to claim 3, wherein said parallel slots are disposed in parallel with respect to the center line of the dielectric strip.

5. A dielectric antenna according to claim 3, wherein said parallel slots are disposed at an acute angle with respect to the center line of the dielectric strip.

6. A dielectric antenna according to claim 1, wherein said plurality of substantially parallel slots is a pair of slots.

7. A dielectric antenna according to claim 1, wherein said plurality of substantially parallel slots is four slots, of which two are disposed on each side of said dielectric resonator.

8. A dielectric antenna according to claim 1, wherein a dielectric lens is disposed above the slots in said second planar conductor.

9. A dielectric antenna according to claim 2, wherein a dielectric lens is disposed above the slots in said second planar conductor.

10. A dielectric antenna according to claim 3, wherein a dielectric lens is disposed above the slots in said second planar conductor.

* * * * *